United States Patent [19]

Irwin

[11] 4,412,681

[45] Nov. 1, 1983

[54] TWO DIMENSIONAL LOGICAL TOY

[76] Inventor: Thomas J. Irwin, 1678 Nottingham Way, N.E., Atlanta, Ga. 30309

[21] Appl. No.: 350,725

[22] Filed: Feb. 22, 1982

[51] Int. Cl.[3] ..... A63F 9/08

[52] U.S. Cl. ..... 273/153 S

[58] Field of Search ..... 434/188, 96, 174, 175; 273/153 S

[56] References Cited

U.S. PATENT DOCUMENTS

| | | | |
|---|---|---|---|
| 332,211 | 12/1885 | Protheroe | 273/153 S |
| 639,602 | 12/1899 | McGenniss | 273/153 S |
| 814,653 | 3/1906 | Healey | 434/175 |
| 2,500,263 | 3/1950 | Pascoo | 434/96 |
| 2,534,550 | 12/1950 | Frechtmann | 434/06 |
| 2,682,119 | 6/1954 | Rutz | 434/175 |
| 2,979,834 | 4/1961 | Giles | 434/174 |
| 3,601,403 | 8/1971 | Weisbecker | 273/153 S X |
| 3,693,291 | 9/1972 | Aoki | 273/86 R X |
| 3,767,202 | 10/1973 | Sternad | 273/153 S X |

FOREIGN PATENT DOCUMENTS

| | | | |
|---|---|---|---|
| 170062 | 12/1977 | Hungary | 273/153 S |

*Primary Examiner*—William H. Grieb
*Attorney, Agent, or Firm*—Rodgers & Rodgers

[57] ABSTRACT

A two dimensional logical toy comprises a frame structure having a slide passage in which a slide plate is slidably mounted and on an apertured surface of which a plurality of parallel grooves are formed together with a single transverse groove, a lift including an elongated pedestal slidably and rotatably mounted within the aperture in said slide plate and provided with a platform on one end in which two sets of parrallel grooves are formed, one set of grooves being normally disposed in alignment with the parallel grooves formed in the slide plate and the other set of grooves being transverse thereto, said lift being movable in said aperture in a direction axially of said pedestal and being rotatable so as to cause the second set of grooves in the lift platform to become aligned with the parallel grooves formed in the slide plate, and a plurality of unitary elements slidably mounted in the grooves formed in the guide plate and in the platform so as to form a wide variety of geometric patterns.

12 Claims, 5 Drawing Figures

TWO DIMENSIONAL LOGICAL TOY

TECHNICAL FIELD

This invention relates to toys and more particularly to a two dimensional device having a plurality of parts which are individually movable to form various patterns.

BACKGROUND ART

According to one known arrangement, a plurality of unitary elements are grouped into six readily recognizable categories and are arranged so as to form the faces of a three dimensional cube. In this known device, the unitary elements may be rearranged so as to form a variety of patterns since the elements of each group are of the same color the groups are of different colors.

DISCLOSURE OF INVENTION

According to this invention in one form a logical toy is provided and comprises frame structure having a grooved surface and having a slide passage formed therein in which a slide plate is slidably mounted on a surface of which a plurality of parallel grooves are formed together with a single transverse groove and through which an aperture extends in normal relation to the surface in which the grooves are formed, a lift having an elongated pedestal slidable and rotatable within the aperture formed in the slide plate and at one end of which a platform having two sets of parallel grooves are formed and wherein the two sets of grooves are in normal relation to each other so that upward movement of said pedestal and of said platform moves the platform out of its normal position in the aperture formed in said slide plate and so that rotation of the pedestal causes the platform to swing through an angle of approximately 90° to reorient one set of grooves in the platform from a position of alignment with the grooves in the slide plate to cause the other set of grooves formed in the platform to become aligned with the grooves in the slide plate, and a plurality of unitary elements slidably mounted in the grooves of the platform and plate and arranged in readily identifiable categories whereby different patterns may be formed by repositioning the unitary elements in the grooves in the platform, in the frame structure and in the slide plate.

BEST MODE OF CARRYING OUT THE INVENTION

Figure 1:
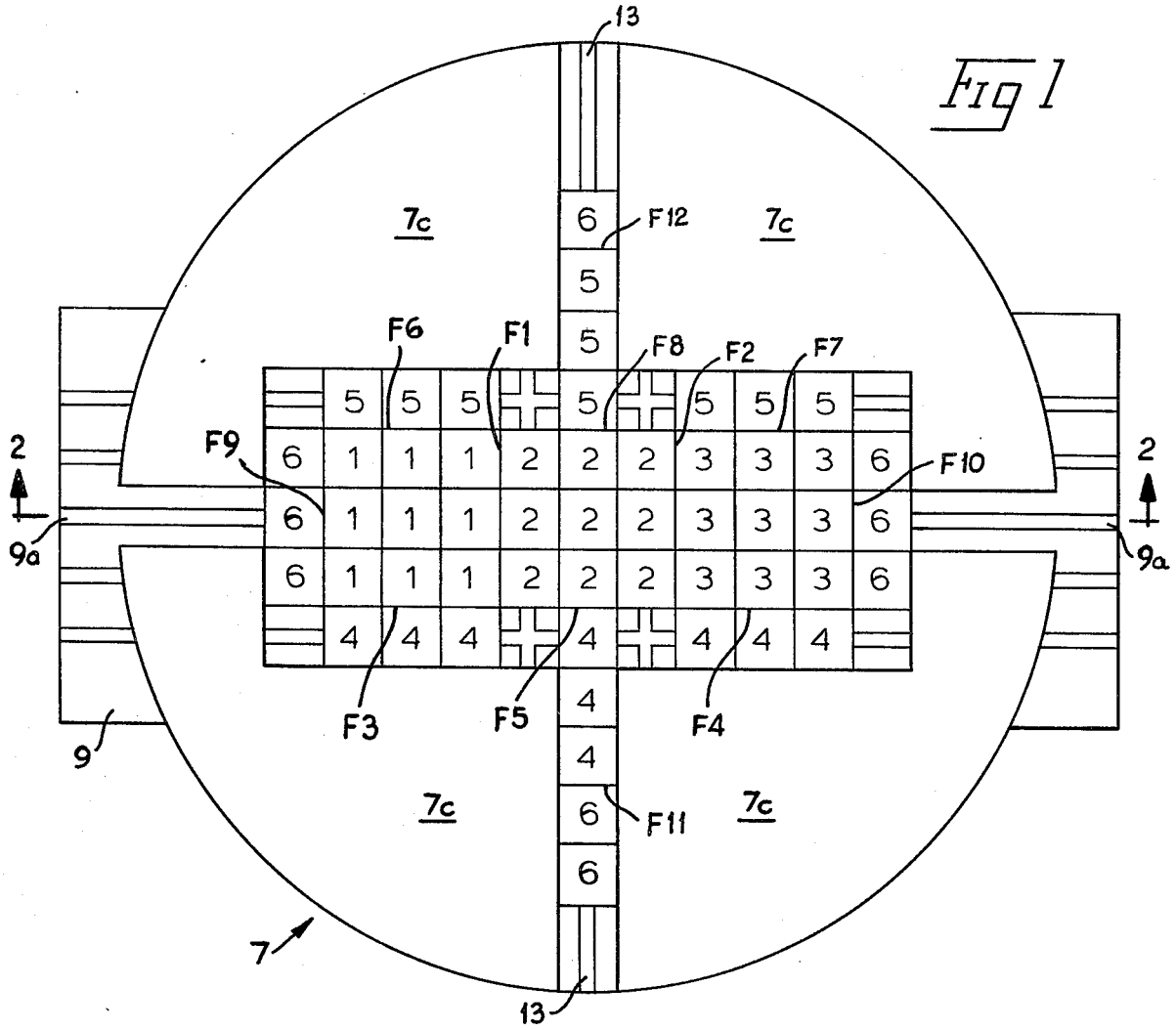
FIG. 1 is a plan view from above of a device constructed according to this invention.
Figure 2:
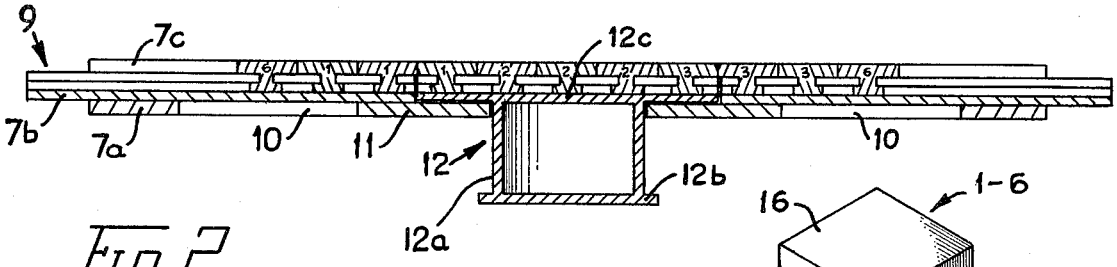
FIG. 2 is a cross-sectional view taken along the line designated 2—2 in FIG. 1.

In the drawings a total of 54 unitary elements are disclosed and are arranged in six groups of nine elements each and the elements of each group are identified by one numeral 1–6. Preferably the elements of each group are of the same color and the groups are of different colors.

Figure 4:
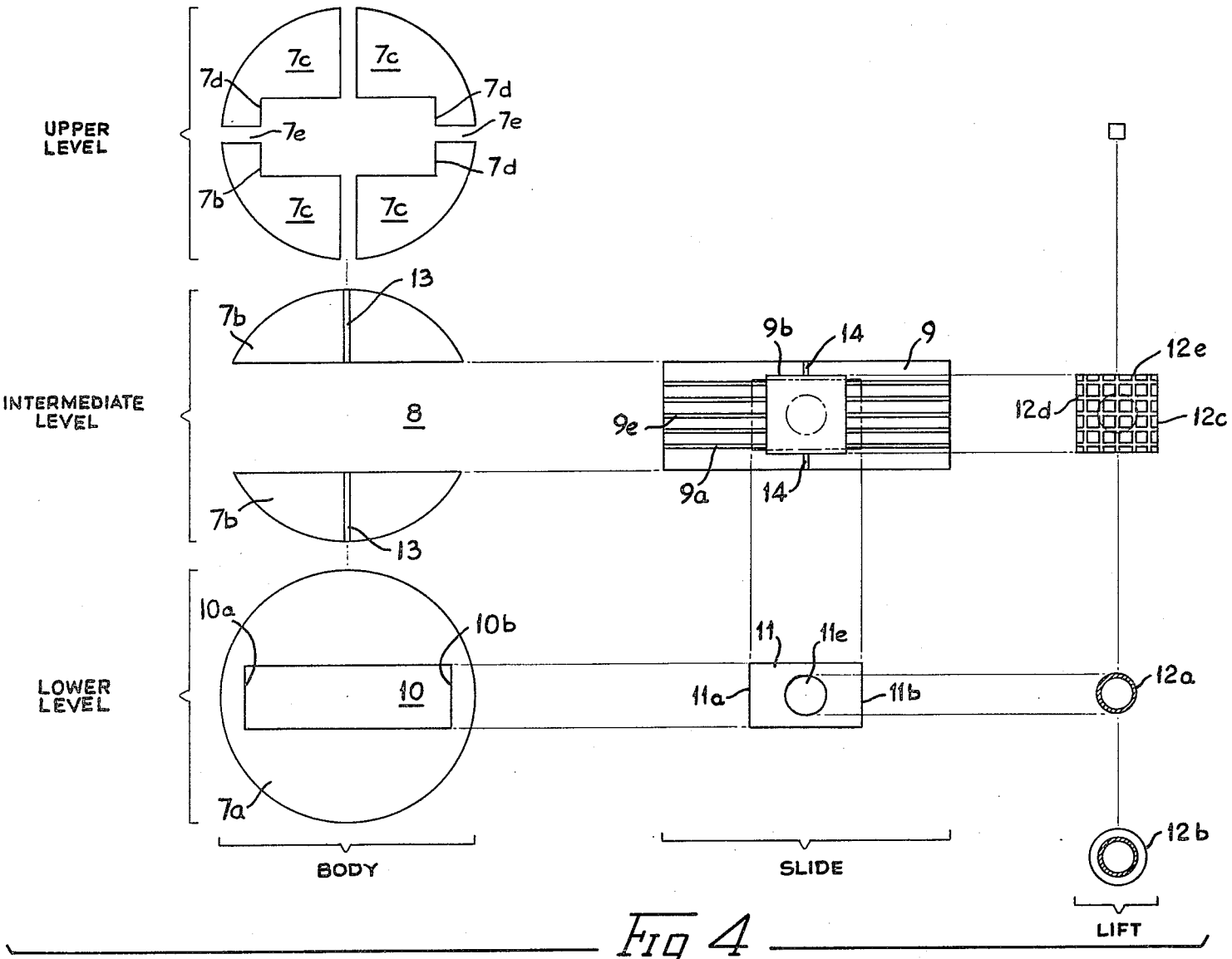
FIG. 4 is an exploded view of the arrangement shown in FIGS. 1 and 2 and with the principal components arranged by levels and FIG. 5 is a perspective view of the structure shown in FIGS. 1 and 2 with certain parts moved out of their normal positions for clarity.

In the drawings a frame structure generally designated by the numeral 7 includes components disposed in a lower, intermediate and upper level designated respectively as **7*a*, 7*b*, and 7*c*. These parts are best shown in detail in FIG. 4. The space between the two parts 7*b* constitutes a slide passage and is designated by the numeral 8. A slide plate 9 is disposed within the slide passage 8 and is slidable therein for a predetermined distance in opposite directions from its center location shown in FIG. 1**.

For limiting the travel of slide plate 9, a slide limiting passage 10 is formed in the lower plate **7*a* immediately adjacent to and in communication with the slide passage 8 and a slide limiting block 11 is mounted therein. Sliding movement of slide limiting block 11 is limited by the ends 10*a* and 10*b* of the slide limiting passage 10 due to engagement of the ends 11*a* and 11*b* respectively with the ends 10*a* and 10*b* of slide limiting passage 10**.

A lift generally designated at 12 includes a lift pedestal **12*a* having a lower flange 12*b* secured to the lower end thereof together with a platform 12*c* mounted atop the pedestal 12*a*. The parts are arranged so that the pedestal 12*a* is disposed within the aperture 11*c* of the slide limiting block 11 and with platform 12*c* disposed in aperture 9*b* in slide plate 9. Lift platform 12*c* includes one set of parallel grooves 12*d* together with a second set of parallel grooves 12*e* which are disposed in normal relation to the grooves 12*d*.**

Thus with the platform and its associated pedestal and flange located in one position, the grooves **12*d* are disposed in alignment with the grooves 9*a* in slide plate 9, the grooved upper surface of lift platform 12*c* being in the same plane as the grooved upper surface of the slide plate 9 since the lift platform 12*c* occupies the aperture 9*b* formed in slide plate 9**.

In order to reorient the groups of grooves **12*d* and 12*e* relative to the grooves 9*a*, it is simply necessary to elevate the lift including the pedestal 12*a*, the flange 12*b* and the platform 12*c* to a position sufficiently high relative to the other parts so as to permit rotation of the lift structure about its vertical axis through an angle of approximately 90° so as to cause the grooves 12*e* to come into alignment with the grooves 9*a* once the platform is lowered into position wherein the grooved upper surface of lift platform 12*c* is disposed in the same plane as the grooved upper surface of slide plate 9**.

The lift structure 12 may be moved transversely relative to the frame structure 7 by simply imparting a sidewise force to the slide 9. Movement of the slide 9 and of the lift 12 is arrested when the end **11*a* of slide limiting block 11 engages the end 10*a* of the slide limiting passage 10. In the other direction, movement of the slide 9 and of the lift 12 is arrested when the end 11*b* of slide limiting block 11 engages the end 10*b* of the slide limiting passage 10**. Of course the lift and slide may be positioned at points intermediate these extreme positions as desired.

For accommodating movement of unitary elements identified by any one of the numerals 1–6 in a direction transverse to the direction of the grooves **9*a* formed in the upper surface of slide plate 9, a transverse groove 13 is formed in plate 7*b* and when the slide plate 9 is disposed in its central position the transverse grooves 13 are in alignment with the transverse grooves 14 formed in slide plate 9**.

Figure 3:
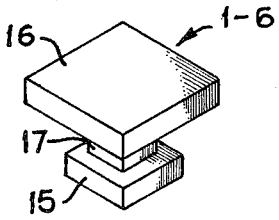
FIG. 3 is a perspective view of a unitary element employed in the practice of the invention.
Figure 5:
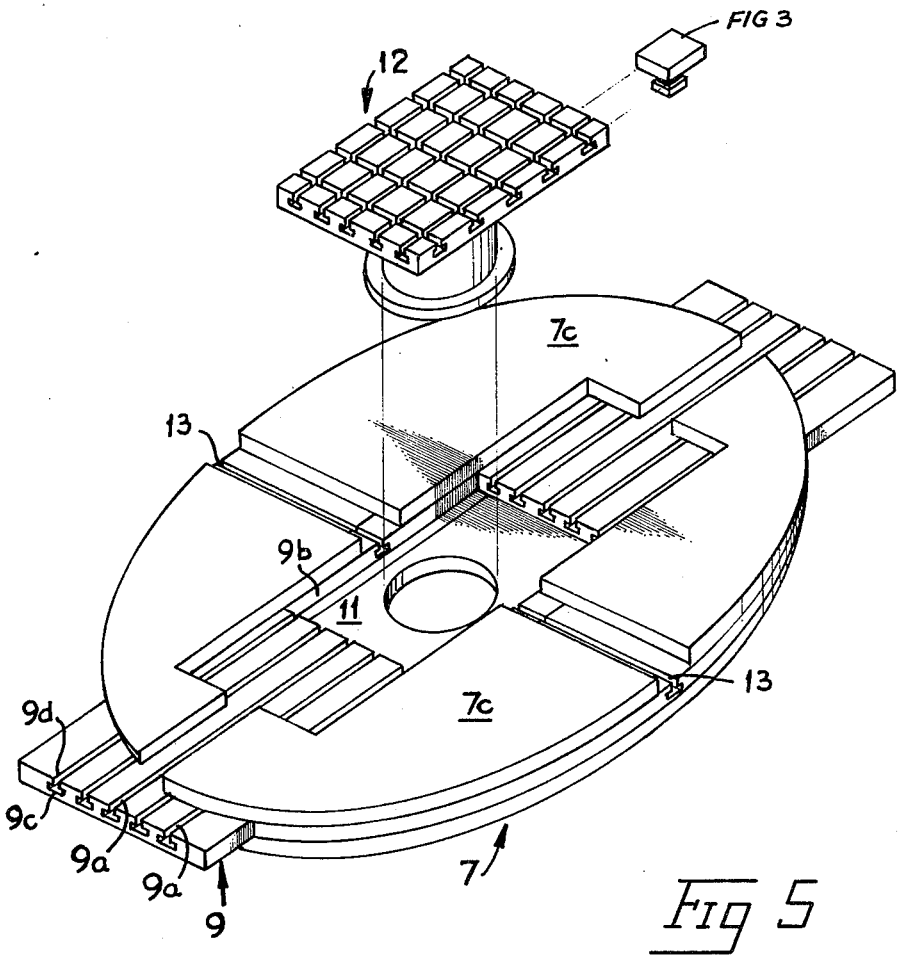

As is best shown in FIG. 3 each of the unitary elements comprises a base portion 15 and a top portion 16 interconnected by an intermediate portion 17. As is best shown in FIG. 5, the grooves such as 9*a* in slide plate 9 include a wide bottom portion 9*c* and a narrow throat portion 9*d*. Thus with the base 15 of a unitary element disposed in the wider portion 9*c* of a groove 9*a*, and with the intermediate portion 17 disposed in the narrow throat portion 9*d* of a groove 9*a*, the unitary elements are secured against undesired dislodgment from the device in a direction generally normal to the top plane of the frame structure.

With reference particularly to FIG. 1, it is apparent that the unitary elements may be shifted from left to right in the grooves 9*a* in slide plate 9 and in the same direction along the grooves 12*d* formed in the lift platform 12*c*. The unitary elements may also be shifted in a transverse direction along the transverse grooves 12*e* formed in the upper surface of platform 12*c*. The unitary elements may slide along the grooves 13 and along the grooves 9*a* formed in slide plate 9 until their motion is limited by engagement with the surface 7*d* in plate 7*c* except that the row of unitary elements which is aligned with the center one 9*e* of the grooves 9*a* may move through the space 7*e* on either side of the device.

While an almost indefinable number of patterns may be formed by simply shifting the unitary elements in one direction or another as contemplated by the invention, it is interesting to note that the particular arrangement of unitary elements as shown in FIG. 1, in effect, constitutes the six sides of a cube wherein the cube sides are laid out into a common plane. For example, the bottom wall of the cube could comprise the nine unitary elements designated by the numeral 2 while the left side wall could constitute the nine unitary elements designated by the numeral 1. The right side wall could constitute the nine unitary elements designated by the numeral 3. Thus the nine elements designated by the numeral 1 may be visualized as being folded 90° upwardly and toward the right along the imaginary line F1 and the units designated by the numeral 3 may be visualized as folded 90° upwardly and toward the left along the imaginary line F2, and the units designated by the numeral 4 may be viewed as folded 90° upwardly along the imaginary line F3 and the imaginary line designated F4. The space between these two rows of units marked 4 may be filled by folding the remaining units 4 upwardly through 90° along the imaginary line F5. The near wall comprising nine units designated by the numeral 4 is thus formed. In like fashion folding of the units 5 upwardly along the imaginary fold lines F6, F7, and F8 forms the imaginary far wall of nine units designated by the numeral 5. Thereafter the imaginary top wall is formed by simply folding through 90° the three units designated 6 along the fold line F9 over toward the right while folding the three units designated 6 through 90° along the imaginary fold line F10 toward the left. The complete top wall is then finished by folding the two units designated 6 through 90° along the imaginary fold line F11 rearwardly and away from the observer while folding the single unit 6 through 90° forwardly along the imaginary fold line F12 to complete the top of the cube made up of the nine units designated by the numeral 6.

It is obvious that this invention is not limited to forming a cube whose walls constitute unitary elements of a single category such as a single color. Many different designs using a variety of colors in each wall may be employed. It is obvious that duplication of patterns in the various walls constitutes a challenging undertaking which affords a worthwhile exercise in visualizing pattern configurations, artistic designs and the like.

I claim:

1. A two dimensional logical toy comprising a frame structure having a slide passage formed therein, a slide plate slidably mounted in said slide passage and having a plurality of parallel grooves formed in a surface thereof and an aperture extending therethrough, a lift having a platform normally disposed in said aperture and having a first group of parallel grooves formed in a surface thereof and normally in alignment with the grooves formed in said guide plate respectively, said lift being movable so as to cause said platform to move out of said aperture and being rotatable and having a second group of parallel grooves formed in said surface of said platform which are disposed in normal relation to said first group of grooves, so that predetermined rotation of said lift and movement of said platform back into said aperture causes said second group of grooves to become aligned with the grooves formed in said slide plate, and a plurality of unitary elements slidably mounted in said grooves formed in said guide plate and in said platform.

2. A device according to claim 1 wherein said unitary elements comprise a plurality of readily identifiable groups of unitary elements.

3. A device according to claim 1 wherein a slide limiting passage is formed in said frame structure immediately adjacent to and in communication with said slide passage and wherein a slide limiting block is movable with said slide plate and engageable with the extremities of said slide limiting passage for determining the limits of sliding movement of said slide plate relative to said frame structure.

4. A device according to claim 3 wherein an aperture is formed in said slide limiting plate and wherein said lift includes a pedestal disposed in said aperture in said slide limiting plate on one end of which said platform is secured.

5. A device according to claim 4 wherein said pedestal is slidable and rotatable in said aperture in said slide limiting plate.

6. A device according to claim 5 wherein a flange is formed on the end of said pedestal remote from said platform.

7. A device according to claim 1 wherein a transverse groove is formed in said frame structure which is disposed in normal relation with said plurality of grooves formed in said slide plate.

8. A device according to claim 7 wherein said groove in said frame structure and said grooves in said slide plate are disposed in substantially the same plane.

9. A device according to claim 7 wherein a transverse groove is formed in said slide plate which is in normal relation with said parallel grooves formed in said slide plate.

10. A device according to claim 1 wherein said unitary elements are of substantially uniform size and configuration.

11. A device according to claim 1 wherein each of said unitary elements comprises a base portion and a top portion interconnected by an intermediate portion.

12. A device according to claim 11 wherein said base portion is of greater transverse dimension than said intermediate portion and wherein said grooves formed in said slide plate, in said platform and in said frame structure are configured to accommodate sliding movement of said unitary elements while preventing dislodgment of said unitary elements from said grooves in a direction out of the plane of the surface in which the grooves are formed.

* * * * *